United States Patent [19]

Brower

[11] Patent Number: 4,931,696

[45] Date of Patent: Jun. 5, 1990

[54] FLUORESCENT LAMP STARTER ASSEMBLY

[75] Inventor: Boyd G. Brower, Williamsport, Pa.

[73] Assignee: GTE Products Corporation, Danvers, Mass.

[21] Appl. No.: 296,313

[22] Filed: Jan. 10, 1989

Related U.S. Application Data

[63] Continuation of Ser. No. 19,388, Feb. 26, 1987, abandoned.

[51] Int. Cl.[5] ..... H01J 7/44

[52] U.S. Cl. ..... 315/61; 315/62; 315/57; 315/290; 315/58; 315/DIG. 7; 361/399; 361/400; 361/401

[58] Field of Search ..... 313/393, 318; 315/57, 315/58, 60, 61, 62, 51, 61, 56, 290, DIG. 7.5, 289; 29/592.1, 829, 832; 361/392, 393, 395, 397, 398, 399, 400, 401, 404, 406, 408, 409

[56] References Cited

U.S. PATENT DOCUMENTS

| | | | |
|---|---|---|---|
| 4,270,071 | 5/1981 | Morton | 315/58 |
| 4,375,607 | 3/1983 | Morton et al. | 315/62 |
| 4,414,489 | 11/1983 | Young | 315/56 |
| 4,495,443 | 1/1985 | Cummings | 315/56 |
| 4,527,098 | 7/1985 | Owen | 315/DIG. 7 |
| 4,656,395 | 4/1987 | Fahnrich et al. | 315/58 |
| 4,683,402 | 7/1987 | Aubrey | 315/56 |

*Primary Examiner*—Leo H. Boudreau
*Assistant Examiner*—Michael Razavi
*Attorney, Agent, or Firm*—Carlo S. Bessone

[57] ABSTRACT

In a fluorescent lamp, a circuit board assembly is provided within the base of the lamp. The circuit board assembly includes a circuit board having a plurality of conductive runs thereon, a lamp starter circuit and device electrically coupling the pins of the lamp base to the circuit board. The conductive runs have a concave cut-out portion located immediately adjacent the location where an electrical coupling lead is coupled (e.g. by soldering) to the runs. The concave cut-out portion prevents the circuit runs from lifting off from the circuit board when the electrical coupling lead is bent after being coupled to the circuit runs.

13 Claims, 4 Drawing Sheets

FLUORESCENT LAMP STARTER ASSEMBLY

This application is a continuation of application Ser. No. 019,388, filed Feb. 26, 1987 and now abandoned.

TECHNICAL FIELD

The present invention relates in general to fluorescent lamps, and pertains, more particularly, to high efficiency, low wattage, multiple tube fluorescent lamps. Even more particularly, the present invention relates to an improved starter assembly for a twin-tube or double twin-tube fluorescent lamp.

BACKGROUND OF THE INVENTION

Reference is now made to the prior art drawing of FIG. 1 illustrating a double twin-tube fluorescent lamp assembly as is presently in manufacture. The fluorescent lamp may be of the type manufactured by GTE Products Corporation, either the 9 watt lamp identified by Sylvania Model No. F9DTT/27K or the 13 watt version identified by Sylvania Model No. F13DTT/27K. A similar construction is also used in the twin-tube fluorescent lamp. These may be the type presently manufactured by GTE Products Corporation under Sylvania Model Nos. F9DTT/27K (9 watt) and F13DTT/27K (13 watt).

In the prior art drawing of FIG. 1, the fluorescent lamp is comprised of the double twin-tube bulb as illustrated at 10 and is provided with the typical jointing connection as indicated in dotted outline at 12. Associated with the bulb 10 are a pair of filaments, only one of which is illustrated in FIG. at 14. The filament 14 has coupled therefrom lead wires 16 and 18.

The double twin-tube bulb 10 is supported in the two-part base that is comprised of a base shell 20 and base bottom 22. The double twin-tube bulb 10 is secured in the base shell 20 by means of an appropriate cement such as is illustrated at 24 in FIG. 1. A pair of exhaust tubulations, only one of which is illustrated in FIG. 1 at 42 project from bulb 10.

FIG. 1 also illustrates the pins 26 and 28 that are supported from the base bottom. The glow bottle 30 and capacitor 32 comprising the starter circuit are contained within the base bottom 22. It is noted that the length of glow bottle 30 is longer than the base bottom 22 and therefore extends into the base shell 20. With regard to the pins 26 and 28, it is noted that one of the filament wires 16 from the filament 14 is staked into the pin 26 while a lead wire 17 coupled from the other filament is captured and staked at the other pin 28. It is noted that in the prior art fluorescent lamp construction of FIG. 1, clamps are employed as illustrated schematically at 34 and 36. These clamps are used to tie together lead wires for electrical connection between the various components, and in particular for connection between the glow bottle 30, capacitor 32, and lamp filaments. In this regard, note that one of the lead wires 18 from the filament 14 couples to the clamp 36. A lead wire covered by insulator sleeve 38 also couples from the other filament to the clamp 34.

In addition to the requirement of the use of clamps as illustrated at 34 and 36 in FIG. 1, there also have to be provided, insulator sleeves 38 and 40. These sleeves are used to prevent electrical shorting of leads. As indicated previously, the lamp starter components are encapsulated in the two-part base with the two lead wires from the respective lamp filaments being inserted into the pins 26 and 28 and staked to complete the assembly.

One of the disadvantages associated with the prior art construction of FIG. 1 is the relatively large number of separate components that are necessary. In addition to the basic required starter components, this prior art construction also required clamps and insulator sleeves.

Another disadvantage with the prior art construction of FIG. 1 is that the lead wires are too long, particularly when considering use in automated processing. Because of the use of several different length lead wires, there is also a danger in having lamp short circuits. Also, the lengthy leads can provide bending and breakage problems that are inherent with long wires.

A further disadvantage of the prior art construction of FIG. 1 is that the assembly of the lamp is expensive to implement. This is primarily because of the number of components and their complexity of assembly. This limits the speed of production and thus means that the manufacturing cost is higher. The maximum speed of production is about 1,000 lamps per hour. The manufacturing efficiency is low and more skilled and unsKilled labor is required to service the manufacturing of the product. Ultimately, this means that the product cost to the customer is relatively expensive employing the construction of FIG. 1.

Reference is also made to U.S. Pat. No 4,426,602. This patent describes a low pressure mercury vapor discharge lamp which is also of prior art construction employing some form of lead interconnection between the filaments and starter circuit.

DISCLOSURE OF THE INVENTION

One object of the present invention, therefore, is to obviate the disadvantages of the prior art.

Another object of the present invention is to provide an improved fluorescent lamp starter assembly employing a circuit board for use with commercially available glow bottles in the assembly of the fluorescent lamp.

A further object of the present invention is to provide an improved fluorescent lamp starter assembly constructed to eliminate short-circuiting problems and to prevent the circuit board runs from lifting off from the circuit board when an electrical coupling wire is adhered thereto.

Still another object of the present invention is to provide an improved fluorescent lamp starter assembly employing a circuit board and having increased manufacturing efficiency thereof.

Still another object of the present invention is to provide an improved fluorescent lamp starter assembly that is assembled on a more automated basis that prior lamps at increased speed of assembly and in which the assembly may be carried out using conventional equipment.

A further object of the present invention is to provide an improvement in the construction of a starter assembly for a fluorescent lamp that enables the lamp to be manufactured more efficiently, at lower cost and in a more reliable and safe manner.

In accordance with one aspect of the invention, there is provided an improved construction for a fluorescent lamp and in particular, an improved fluorescent lamp starter assembly comprising a circuit board assembly. The fluorescent lamp includes a fluorescent tube that is preferably either of twin-tube of double twin-tube configuration. The fluorescent tube includes electrode means supported therein. A base has pin means attached thereto and projecting therefrom and is provided for supporting the fluorescent tube. This base may preferably be a two-part base including a base shell from which the fluorescent tube is supported and a base bottom. The pin means, in the form of a pair of oppositely disposed pins, are adapted to be coupled to an energy source for energization of the fluorescent lamp. The circuit board assembly includes lamp starter circuit means including a glow bottle and a circuit board having conductive runs thereon (e.g., four) and having a hole therein adapted to receive an end of the glow bottle. The lamp starter circuit means is supported from the circuit board and connects to circuit runs of the board. Preferably, the conductive runs are located on a surface of the circuit board facing in a direction toward the pin means. The lamp starter circuit means may typically comprise a glow bottle and capacitor. Means are provided for connecting the electrode means of the fluorescent tube to the circuit board conductive runs. Lastly, means are provided for electrically coupling the pin means to the circuit board conductive runs.

In accordance with further aspects of the present invention, the fluorescent tube includes an exhaust tubulation projecting therefrom and the circuit board includes an aperture to receive the exhaust tubulation. In accordance with further teachings, the circuit board includes first and second apertures to respectively receive first and second exhaust tubulations from the fluorescent tube.

In accordance with still further aspects of the present invention, the means electrically coupling the pin means to the circuit board conductive runs includes an electrical coupling lead. One end of the electrical coupling lead is affixed to the pin means by means of a crimp in the pin means. Preferably, the conductive runs have a concave cut-out portion and the electrical coupling lead is soldered to the conductive runs immediately adjacent the concave cut-out portion.

In accordance with further teachings of the present invention, a module is preassembled with the circuit board comprising the glow bottle, capacitor and the electrical coupling means. This preassembly step may be carried out at high speeds using conventional assembly equipment. In accordance with the assembly sequence regarding the printed circuit board module, initially a printed circuit board having conductive runs containing a concave cut-out portion and having a hole therein is provided. A lamp starter circuit means including a glow bottle and capacitor is connected to the conductive runs. One end of the glow bottle is positioned within the hole in the printed circuit board. An electrical coupling lead is positioned horizontal to the printed circuit board and connected immediately adjacent the concave cut-out portion in the conductive runs. The electrical coupling lead is bent perpendicular to the printed circuit board.

As indicated previously, the fluorescent lamp, in addition to the multi-tube bulb also includes a base comprised of a base shell and base bottom. The fluorescent bulb is secured in the base shell with filament leads extending therefrom. The circuit board assembly module is positioned within the base shell and the filament lead wires are secured thereto. The base bottom is engaged with the base shell disposed over the circuit board, encasing the starter circuit (capacitor and glow bottle) and thereafter the pin means are connected to the electrical coupling means. Preferably, the circuit board is provided with an aperture to receive the exhaust tubulation of the fluorescent tube.

BEST MODE FOR CARRYING OUT THE INVENTION

For a better understanding of the present invention, together with other and further objects, advantages and capabilities thereof, reference is made to the following disclosure and appended claims taken in conjunction with the the above-described drawings.

Figure 1:
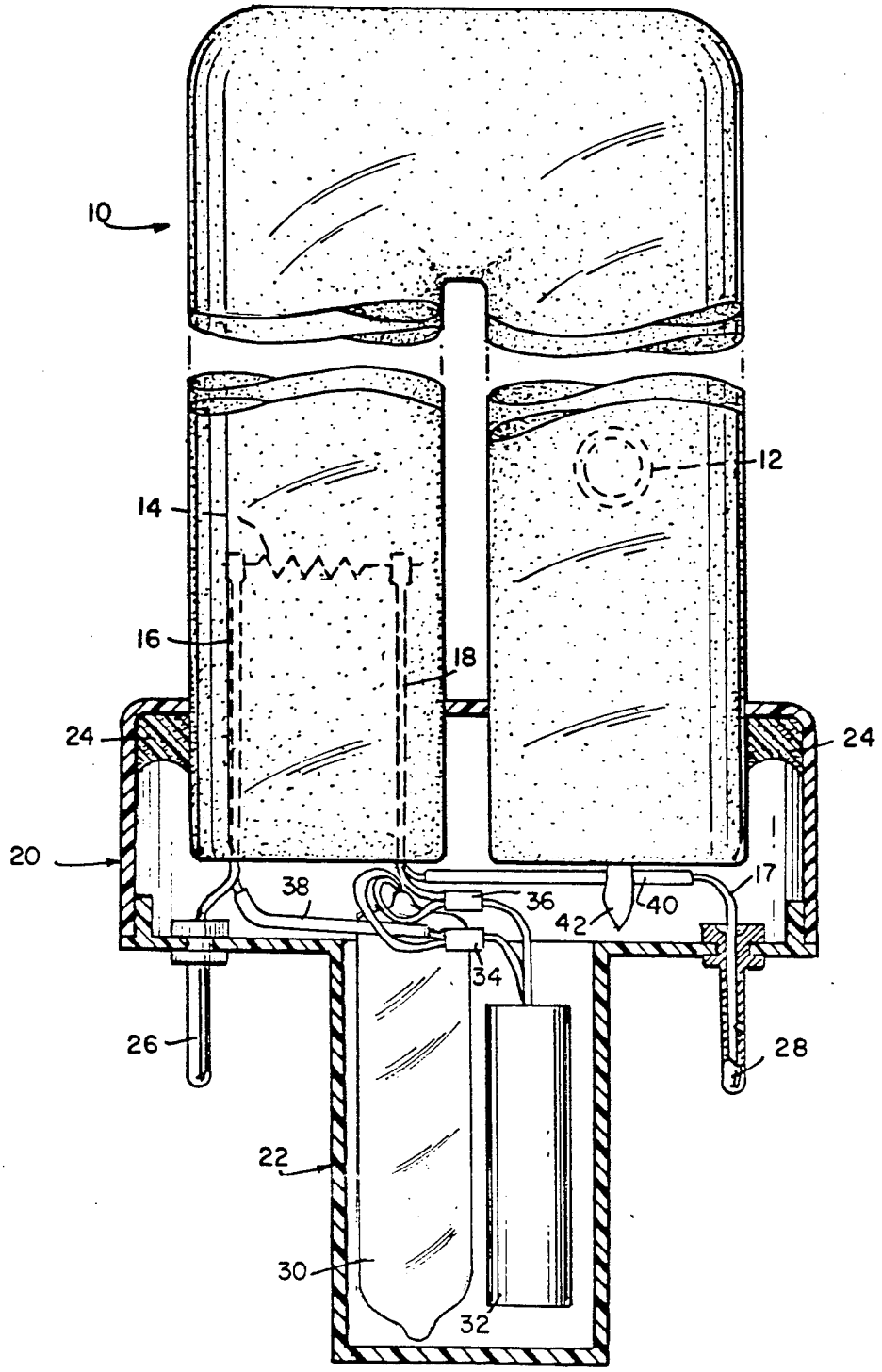
FIG. 1 PRIOR ART
FIG. 1 is a side elevation view, in partial cross-section illustrating a prior art construction of a double twin-tube fluorescent lamp.
Figure 6:
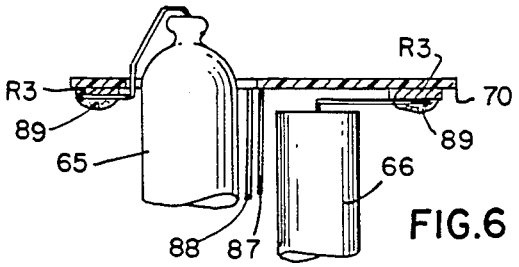
FIG. 6 is a side elevation view of the circuit board assembly illustrating the glow bottle, capacitor and electrical coupling leads secured to the circuit board; and FIGS. *7a* and *7b* illustrate fragmentary views of a preferred method for securing and forming the electrical coupling lead.

In accordance with the present invention, the fluorescent lamp has a starter circuit that now includes a circuit board. The circuit board enables ready securing of the glow bottle, capacitor and electrical coupling leads in a compact module. Refer to FIG. 6 for an illustration of the basic module. This module can be preassembled at high speed using conventional equipment. These modules can be manufactured at a speed of about 4,000 per hour. This means that there is a lower equipment cost and less labor to assemble parts, again reducing the cost of the overall product. The on-line assembly operation costs less due to fewer components in the overall device. In this regard, compare FIGS. 1 and 2.

Figure 2:
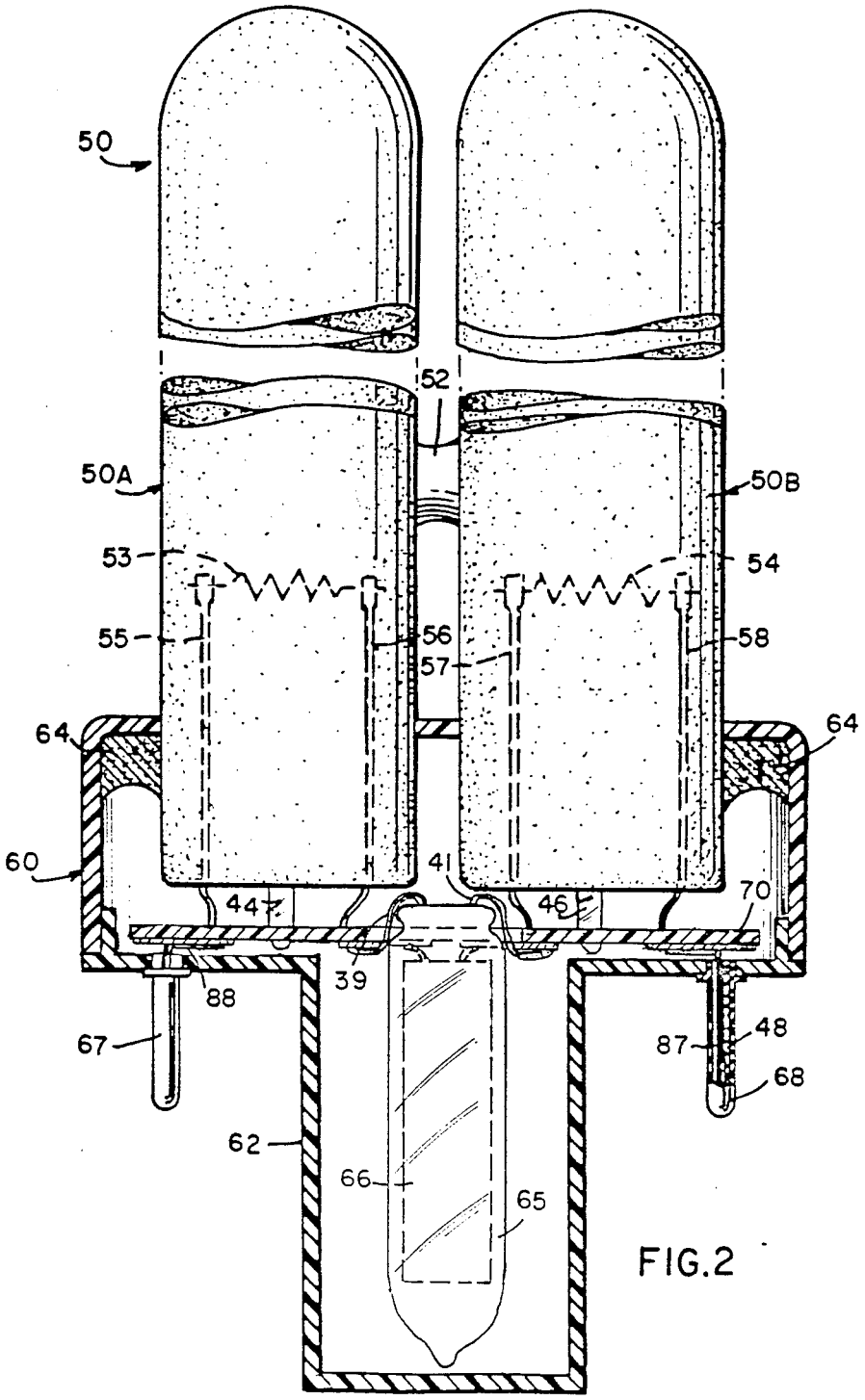
FIG. 2 is a front elevation view, in partial cross-section of an embodiment in accordance with the present invention employing a circuit board.
Figure 3:
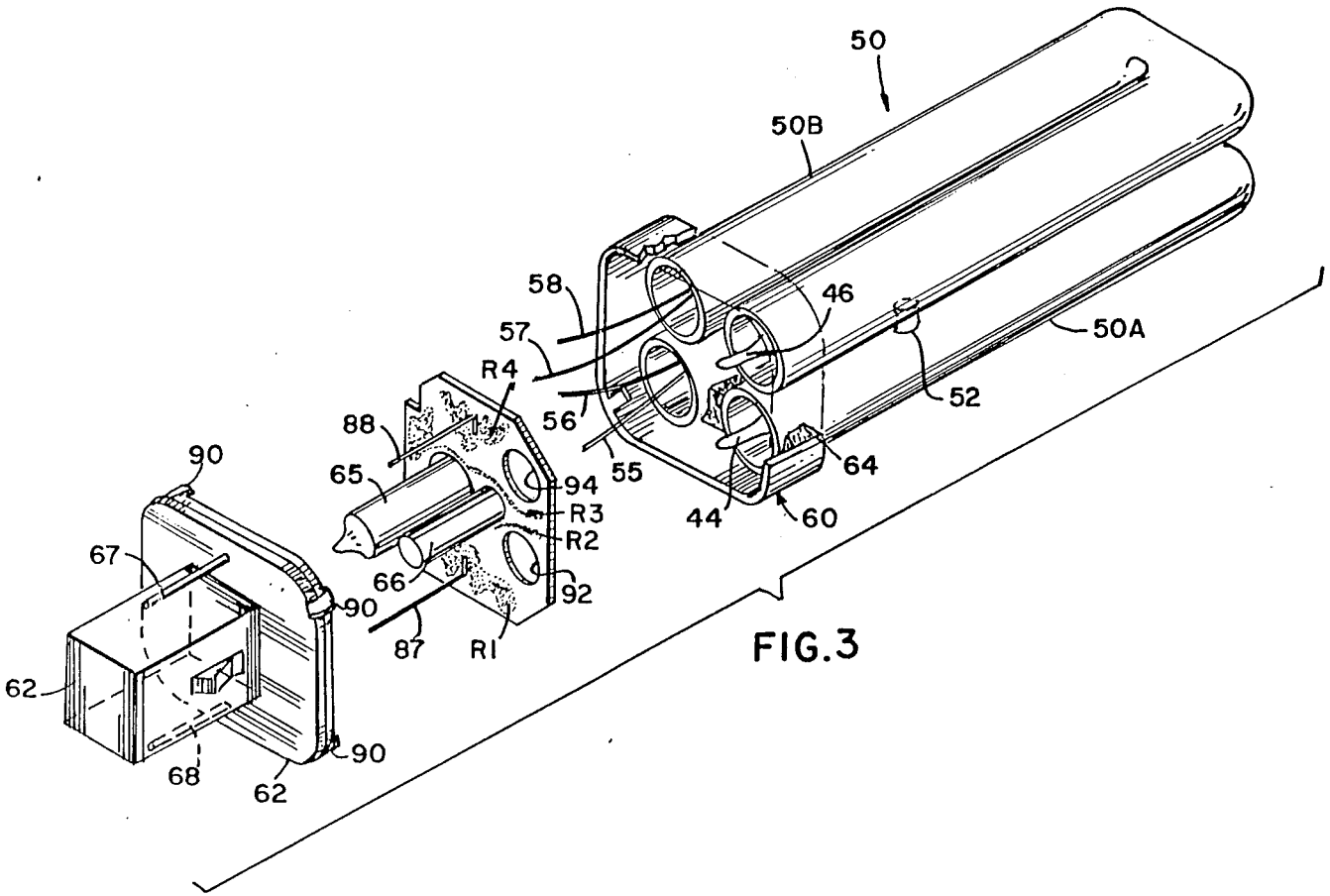
FIG. 3 is an exploded perspective view of the double twin-tube fluorescent lamp of FIG. 2 showing further details and cooperation of parts.

The manufacturing efficiency is much higher with the improved version of the invention as illustrated in FIGS. 2 and 3. This further reduces the cost of the overall product. Also, with the use of the circuit board in the assembly, lead lengths are drastically reduced or, in some instances, essentially eliminated and with the use of a circuit board, short circuit problems are essentially eliminated. The construction of the device is such as to provide a more reliable and safer product and is characterized by improved quality at lower cost.

Reference is now made to FIGS. 2 and 3. FIG. 2 is a front elevation view showing the complete lamp assembly. FIG. 3 is an exploded perspective view showing still further lamp details. The principles of the present invention may be employed in the construction of either twin-tube or double twin-tube fluorescent lamps. The principles of the invention may be employed in constructing different wattage lamps, such as the typical 9 watt and 13 watt compact, high efficiency fluorescent lamps. Moreover, it is expected that the principles of the invention may be employed in the assembly of other lighting products, particularly ones requiring the assembly of more than one circuit component.

FIGS. 2 and 3 illustrate a double twin-tube fluorescent lamp comprising the double twin-tube bulb 50 comprised of single twin-tube bulbs 50A and 50B intercoupled via the jointing connection 52. Filaments 53 and 54 are supported in the respective tubes 50A and 50B. The filament 53 has associated lead wires 55 and 56 while the filament 54 has associated lead wires 57 and 5B. The lead wires 55–58 are secured to the circuit board 70 as will be described in further detail hereinafter. Exhaust tubulations 44 and 46 project from the respective tubes 50A and 50B.

A base is provided for supporting the starter circuit, circuit board 70, and the double twin-tube bulb 50. The base is comprised of a base shell 60 and a base bottom 62. The double twin-tube bulb 50 is secured in the base shell 60 as illustrated in FIG. 2 with the use of a suitable cement as indicated at 64. Pins 67 and 68 are attached to and project from base bottom 62.

FIGS. 2 and 3 also illustrate the lamp starter circuit means itself, which is comprised primarily of the glow bottle 65 having a pair of leads 39, 41 projecting from one end thereof and capacitor 66. Glow bottle 65 has a length greater than base bottom 62 and therefore extends into the base shell 60. An example of such a glow bottle is the GB-5A manufactured by GTE Sylvania S.A., San Jose, Costa Rica which has a length (excluding leads) of approximately 1.160 inches (2.946 centimeters). Also illustrated are the electrical coupling leads 87 and 88 depending from the circuit board 70 for electrically coupling the base pins to the circuit board.

Figure 5:
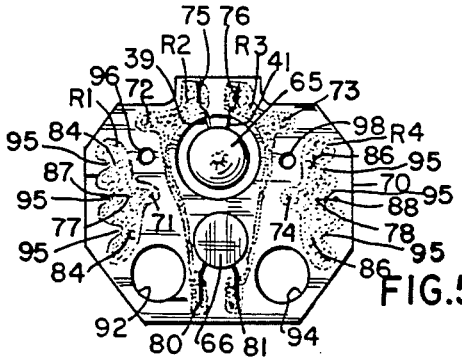
FIG. 5 is a plan view of the circuit board itself illustrating the configuration of circuit runs.

Reference is now made to FIGS. 5 and 6 for further details of the circuit board 70 and associated components mounted therefrom as particularly illustrated in FIG. 6. The circuit board 70 can be manufactured using known technologies including die stamping, silk screening, or etching. The circuit board is comprised of a suitable substrate board with tin-coated copper foil as the circuit material. As illustrated in FIG. 5, the circuit board 70 has four circuit runs identified as runs R1–R4.

With regard to the connections of the various components to the circuit board 70, in FIG. 5 the lead wire 55 from filament 53 is fed through lead wire hole 96 and is coupled to the location 71 of circuit run R1. The other lead wire 56 from filament 53 is coupled to the location 72 of circuit run R2. The lead wire 57 of filament 54 is coupled to location 73 circuit run R3. The other lead wire 58 of filament 54 is fed through lead wire hole 98 in circuit board 70 and is coupled to the location 74 of circuit run R4. Furthermore, the leads 39, 41 of the glow bottle 65 connect to respective locations 75 and 76 on respective circuit runs R2 and R3. The lead wires from the capacitor couple to locations 80 and 81 on respective circuit runs R2 and R3 in FIG. 5. It was found that holding the circuit board and the wires in the correct relationship and then flowing solder either up through holes or over the surface of the circuit board resulted in poor joints caused by both the oxide on leads close to a component and by the reluctance of the solder to flow up through un-plated holes and across the surface of the circuit board. Therefore, as shown in FIGS. 5 and 6, all component leads being soldered to the circuit board runs are positioned parallel to the board surface and far enough from the components to allow easy access and to provide consistent solder joints.

Figure 7A:
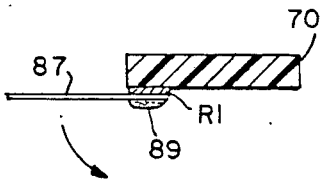
Figure 7B:
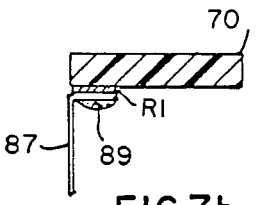

The runs R1 and R4 have locations 77 and 78 associated respectively with electrical coupling leads B7 and BB. Also, additional locations 81 and B6 are provided respectively on circuit runs R1 and R1 to alternatively locate electrical coupling wires 87 and 88 in the event pins 67 and 68 in base bottom 62 are off center to the axis of the lamp, as is customary in European-type bases. Each location 77, 84 and 78, 88, as shown in FIG. 5, is immediately adjacent a concave portion 95 in runs R1 and R4, respectively. It was discovered that by providing a concave cut-out portion 95 in the circuit board run immediately adjacent a location where an electrical coupling lead is to be soldered the electrical lead can be positioned horizontal to the circuit board and directly over the concave cut-out portion, soldered and then bent outwards from the circuit board without having the circuit run lift off from the circuit board. By way of example, FIG. 7*a* illustrates the securing of electrical coupling lead 87 to run R1 of the circuit board 70. In FIG. 7*a* the electrical coupling wire 87 is positioned horizontal to circuit board 70 and connected to run R1 by solder 89. The electrical coupling lead 87 is then bent perpendicular to the circuit board 70 as shown in FIG. 7*b* to align with the base pins (see FIGS. 2 and 3). It is understood that the circuit runs can be provided in different configurations than that illustrated in FIG. 5.

As further shown in FIG. 5, the circuit board 70 is provided with a first aperture 92 and a second aperture 94 to respectively receive first and second exhaust tubulations 44 and 46 (see FIGS. 2 and 3) and prevent breakage thereof. The diameter of the apertures is greater than the diameter of the exhaust tubulation to provide a sufficient amount of lateral clearance between the exhaust tubulation and the circuit board.

Figure 4:
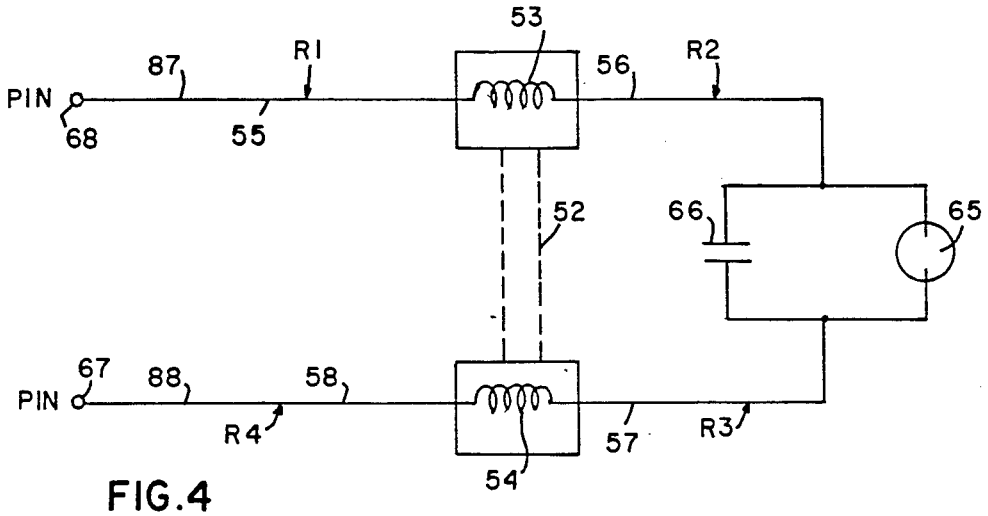
FIG. 4 is a schematic circuit diagram of the circuit interconnection of lamp components

Reference is now made to FIG. 4 which shows the complete schematic circuit diagram. In FIG. 4 it is noted that connection to the filament 53 is made from the input pin 68 by way of electrical coupling lead 87, circuit run R1, and lead wire 55. From lead wire 56 of the filament 53, the connection is by way of the circuit run R2 to the lead wires on one side of glow bottle 65 and capacitor 66. The other side leads of glow bottle 65 and capacitor 66 connect by way of the circuit run R3 to the lead wire 57 of filament 54. The other lead wire 58 of filament 54 couples by way of circuit run R4 and electrical coupling lead 88 to pin 67.

As indicated previously, the glow bottle, capacitor, electrical coupling leads and circuit board form a module. Once this circuit board module has been assembled such as illustrated in FIG. 5, then the circuit board may be positioned into the base shell 60 as in FIG. 2 but leaving sufficient clearance so that one can also secure the filament leads 55, 56, 57, 58 respectively at locations 71, 72, 73, 74 to attach the filaments also to the circuit board. To carry this out, the filament lead wires 55, 58 extend through the corresponding holes 96, 98 while filament lead wires 56, 57 are bent around circuit board 70. The filament leads are soldered or otherwise suitably secured on the bottom surface of the circuit board facing in a direction toward the base pins. The circuit board 70 is properly aligned in a manner wherein first aperture 92 and second aperture 94 in circuit board 70 receives exhaust tubulations 44 and 46, respectively, from the tubes. Once the filament leads are soldered, then the circuit board 70 is for the most part supported directly by these lead wires.

After the circuit board 70 is in place, the electrical coupling leads 87, 88 are aligned respectively within pins 68, 67 (see FIG. 2) of base bottom 62. Base bottom 62 is snapped into engagement with the base shell 60. In this connection, the base bottom 62 may have a conventional type of snap securing member such as illustrated at 90 in FIG. 3, Finally, the electrical coupling leads are affixed to each pin, for example, by means of staking.

Thus, in accordance with the present invention, there is provided an improved arrangement for providing continuity between the fluorescent bulb, glow bottle, capacitor, and pins. In addition to providing electrical continuity, the circuit board also provides a mounting structure for these components. The circuit board is made of an insulating material which thus prevents shorting between leads. The circuit components are attached to the board preferably using conventional industry technology. The product is fabricated in a manner so that the components are secured in fixed position to that they cannot move, be dislodged or disconnect from the circuit board during handling of the product.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a fluorescent lamp including a fluorescent tube having electrode means supported therein, a base from which the fluorescent tube is supported, and pin means attached to and projecting from said base for enabling energy coupling to said electrode means, a circuit board assembly within said base and comprising; lamp starting circuit means including a glow bottle, a circuit board having conductive runs thereon and having a hole therein to receive an end of said glow bottle, said conductive runs having a concave cut-out portion, means connecting the lamp starting circuit means to the circuit board conductive runs, means connecting the lamp electrode means to the circuit board conductive runs, and means electrically coupling said pin means to the circuit board conductive runs including an electrical coupling lead soldered to said conductive runs immediately adjacent said concave cut-out portion.

2. In a fluorescent lamp as set forth in claim 1 wherein said hole in said circuit board is adapted to receive an end of said glow bottle having a pair of leads projecting therefrom.

3. In a fluorescent lamp as set forth in claim 1 wherein said conductive runs are located on a surface of said circuit board facing in a direction toward said pin means.

4. In a fluorescent lamp as set forth in claim 3 wherein said circuit board includes four conductive runs.

5. In a fluorescent lamp as set forth in claim 1 wherein said fluorescent tube includes an exhaust tubulation projecting therefrom and said circuit board includes an aperture to receive said exhaust tubulation.

6. In a fluorescent lamp as set forth in claim 5 wherein said fluorescent tube includes first and second exhaust tubulations projecting therefrom and said circuit board includes first and second apertures to respectively receive said first and second exhaust tubulations.

7. In a fluorescent lamp as set forth in claim 1 wherein said lamp starter circuit means comprises said glow bottle and a capacitor coupled to conductive runs of the circuit board to dispose the glow bottle and capacitor in a parallel circuit.

8. In a fluorescent lamp as set forth in claim 1 wherein the means connecting the lamp starter circuit means to the conductive runs includes solder means.

9. In a fluorescent lamp as set forth in claim 1 wherein the means connecting the lamp electrode means to the conductive runs includes solder means.

10. In a fluorescent lamp as set forth in claim 1 wherein said lamp base includes a base shell and base bottom with the circuit board disposed over the base bottom.

11. In a fluorescent lamp as set forth in claim 10 wherein said electrical lead coupling said pin means to the circuit board conductive runs has one end thereof affixed to said pin means by means of staking.

12. A fluorescent lamp comprising:

a multi-section fluorescent tube including electrode means supported therein;

a base having pin means attached thereto and projecting therefrom for enabling energy coupling to said electrode means;

a circuit board assembly including:

lamp starter circuit means including a glow bottle, a printed circuit board having conductive runs containing a concave cut-out portion and having a hole therein to receive an end of said glow bottle, said printed circuit board having an electrical coupling lead for electrically coupling said pin means to said conductive runs, said electrical coupling lead being soldered to said conductive runs immediately adjacent said concave cut-out portion, and lead means for connecting the electrode means of said fluorescent tube to said printed circuit board conductive runs.

13. A method of assembling a printed circuit board module for a fluorescent lamp comprising the steps of:

providing a printed circuit board having conductive runs containing a concave cut-out portion and having a hole therein.

connecting a lamp starter circuit means including a glow bottle and capacitor to said conductive runs, one end of said glow bottle being positioned within said hole in said printed circuit board.

positioning an electrical coupling lead horizontal to said printed circuit: board and connecting said electrical coupling lead immediately adjacent said concave cut-out portion in said conductive runs.

bending said electrical coupling lead perpendicular to said printed circuit board.

* * * * *